US012747896B2

(12) United States Patent
Lantz

(10) Patent No.: US 12,747,896 B2
(45) Date of Patent: Sep. 29, 2026

(54) EVAPORATOR-CONDENSER SYSTEM WITHOUT EXTERNAL HEATING AND COOLING

(71) Applicant: Illuminated Extractors, Ltd., Fort Collins, CO (US)

(72) Inventor: Zachary R. Lantz, Fort Collins, CO (US)

(73) Assignee: Illuminated Extractors, Ltd., Fort Collins, CO (US)

( * ) Notice: Subject to any disclaimer, the term of this patent is extended or adjusted under 35 U.S.C. 154(b) by 303 days.

(21) Appl. No.: 18/608,745

(22) Filed: Mar. 18, 2024

(65) Prior Publication Data

US 2024/0310091 A1 Sep. 19, 2024

Related U.S. Application Data

(60) Provisional application No. 63/453,073, filed on Mar. 18, 2023.

(51) Int. Cl.
*F25B 41/20* (2021.01)
*F25B 49/02* (2006.01)

(52) U.S. Cl.
CPC ..... *F25B 41/20* (2021.01); *F25B 49/022* (2013.01); *F25B 2400/23* (2013.01)

(58) Field of Classification Search
CPC .... F25B 41/20; F25B 49/022; F25B 2400/23; F25B 1/00; F28D 1/0461
See application file for complete search history.

(56) References Cited

U.S. PATENT DOCUMENTS 1,592,892 A * 7/1926 Mccuen ..... F25B 1/00 62/505
2022/0128272 A1* 4/2022 Lantz ..... F25B 41/22

* cited by examiner

*Primary Examiner* — Miguel A Diaz
(74) *Attorney, Agent, or Firm* — Samuel M. Freund; Cochran Freund & Young LLC

(57) ABSTRACT

An apparatus and method for evaporating and condensing liquids in the absence of external heating and cooling. A volatile liquid, contained in either the core or outer chambers of a jacketed container is cooled by depressurization, which results in auto-refrigeration of the liquid as it evaporates. The resulting vapor may be directed to the inlet of a compressor, where the vapor is pressurized and heated, and then directed into the other chamber of the jacketed container from which it was vaporized. Heat is removed from the compressed, heated vapor by the auto-cooled liquid in the other chamber causing the hot, pressurized vapor to transition in turn to a hot vapor, a cooler vapor, a warm liquid, and finally a cold liquid. The resulting condensed and chilled solvent liquid can then be removed from the jacketed container through a back pressure valve, for re-use.

19 Claims, 1 Drawing Sheet

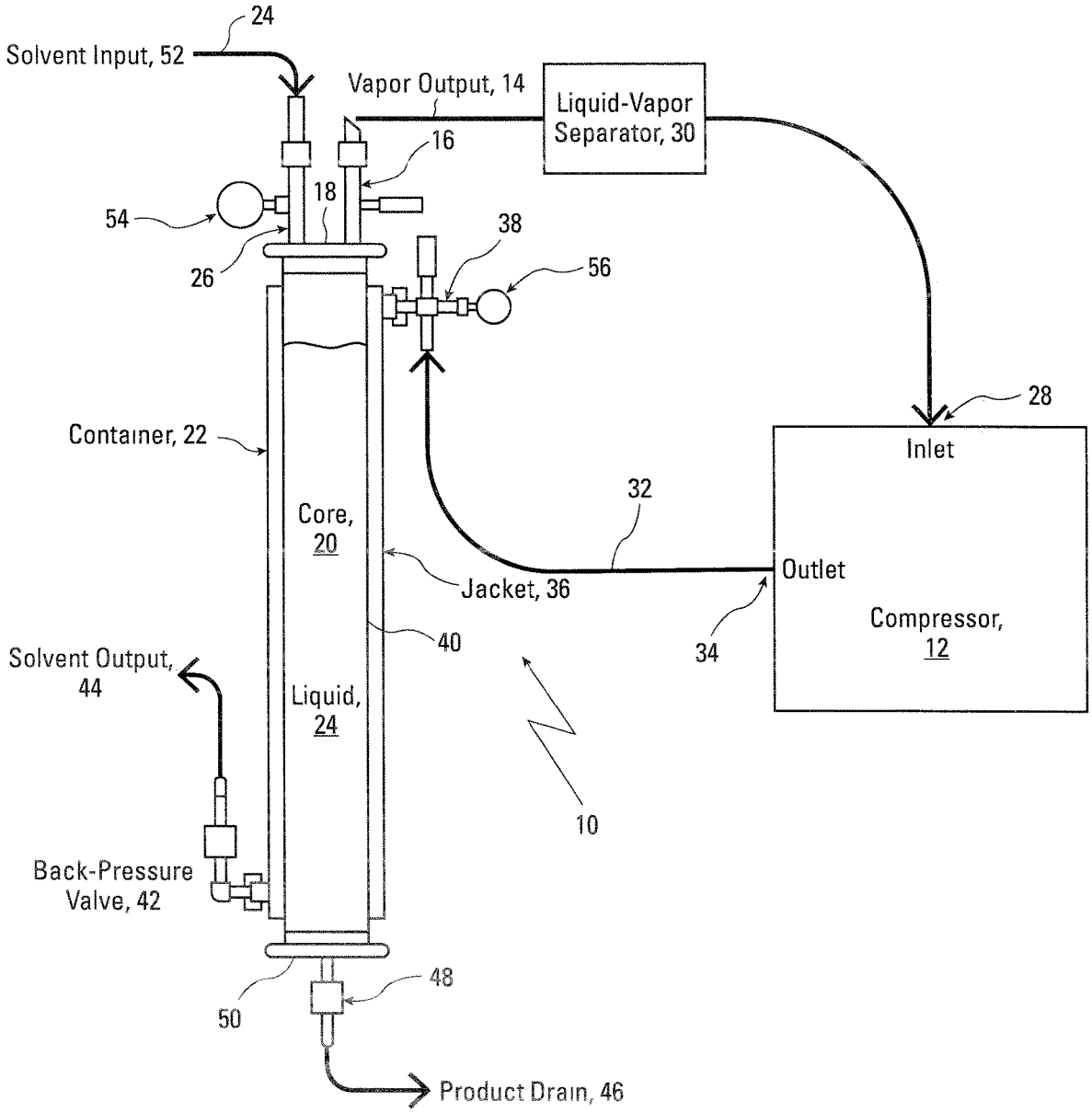
24
Solvent Input, 52
Vapor Output, 14
Liquid-Vapor Separator, 30
16
18
54
38
26
56
28
Container, 22
Inlet
32
Core, 20
Outlet
Jacket, 36
Compressor, 12
40
34
Solvent Output, 44
Liquid, 24
10
Back-Pressure Valve, 42
48
50
Product Drain, 46

EVAPORATOR-CONDENSER SYSTEM WITHOUT EXTERNAL HEATING AND COOLING

CROSS-REFERENCE TO RELATED APPLICATIONS

The present application claims the benefit of U.S. Provisional Patent Application No. 63/453,073 for "Net Zero Evaporator-Condenser" by Zachary Richard Lantz, which was filed on Mar. 18, 2023, the entire content of which application is hereby specifically incorporated by reference herein for all that it discloses and teaches.

BACKGROUND

Solvent evaporation and condensation typically require an input of ancillary heat and ancillary cooling, respectively, to achieve vaporization and condensation of the solvent. In such situations, a 10 KW-50 KW hot water heater is utilized to heat the solvent and solvent-extracted material in order to induce boiling of the solvent, and a compressor then compresses the resulting solvent gas. Alternatively, if a passive method is employed, a matched amount of cooling is applied to a condenser into which the vapor is allowed to flow from the evaporator.

When a compressor is used, a condenser is typically utilized as well, such that a reduced amount of cooling is required to condense the solvent vapor. Standard refrigerators, designed to operate on 100+ ° F. days apply this principle.

SUMMARY

In accordance with the purposes of the present invention, as embodied and broadly described herein, an embodiment of the evaporation-condenser system without external heating and cooling, hereof, includes: a source of liquid refrigerant; an evaporator-condenser, including: a core chamber having an outer wall, a top and a bottom, forming a fluid-tight core chamber for receiving liquid refrigerant from the source of liquid refrigerant and for holding liquid and vapor refrigerant; an outer chamber surrounding the core chamber, including an outer wall a top and a bottom, and having an inner wall including the outer wall of the core chamber, forming a fluid-tight outer chamber for receiving compressed and heated refrigerant vapor; a liquid refrigerant inlet valve in fluid communication with the core chamber through the top for filling the core chamber with a chosen quantity of liquid refrigerant (may be replaced by a 3-way valve in the situation where the present system is part of an extraction system); a refrigerant vapor outlet valve (not required, but used in the present system) in fluid communication with the core chamber through the top for removing refrigerant vapor from the core chamber; a liquid drain valve in fluid communication with the core chamber through the bottom for draining liquids from the core chamber (not generally needed if the bottom of the core chamber can be removed); a refrigerant vapor inlet valve in fluid communication with the outer chamber near the top thereof for inputting refrigerant vapor to the outer chamber (used for setting the back-pressure valve in a partially open position); and a back-pressure control valve in fluid communication with the outer chamber near the bottom thereof for controlling refrigerant vapor pressure therein and for removing liquid refrigerant; and a gas compressor having an inlet for creating reduced pressure on the liquid and vapor refrigerant through the refrigerant vapor outlet valve, for receiving refrigerant vapor from the core chamber, and for generating pressurized, heated refrigerant vapor therefrom, and an outlet for directing the pressurized, heated refrigerant vapor through the refrigerant vapor inlet valve of the outer chamber.

In another aspect of the present invention, and in accordance with its purposes, an embodiment of the method for condensing pressurized, heated, refrigerant vapor without using external heating and cooling, includes: providing liquid refrigerant to a first chamber having an outer wall; reducing the pressure over the liquid refrigerant until it boils and cools (auto-refrigeration), thereby generating refrigerant vapor; directing the generated refrigerant vapor to the inlet of a gas compressor; pressurizing the refrigerant vapor, whereby the pressurized refrigerant vapor is heated and compressed, and exits the compressor through an outlet thereof; introducing the compressed, heated refrigerant vapor into a second chamber surrounding the outer wall of the first chamber, such that the compressed, heated refrigerant vapor is in thermal contact with the outer wall, where it is cooled by heat transfer to the boiling liquid refrigerant; maintaining pressure of the compressed, heated refrigerant vapor in the second chamber using a back-pressure control valve, such that sufficient heat is transferred to the boiling liquid to maintain boiling; permitting the compressed, heated refrigerant vapor to cool sufficiently that the compressed, heated refrigerant vapor is liquefied, forming liquefied refrigerant; and removing the liquefied refrigerant through the back-pressure control valve for repurposing.

Benefits and advantages of embodiments of the present invention include, but are not limited to, providing an apparatus and method for evaporation and condensation of a volatile liquid where a vapor is compressed and heated using the heat of compression along with a back pressure valve, such that no ancillary heat is required, and the same liquid is boiled with resulting cooling in a separate chamber in thermal communication with the heated and compressed vapor, such that no ancillary cooling is required for condensation of the compressed vapor.

BRIEF DESCRIPTION OF THE DRAWING

The accompanying FIGURE, which is incorporated in and forms a part of the specification, illustrates an embodiment of the present invention and, together with the description, serves to explain the principles of the invention.

The FIGURE is a schematic representation of a side view of an embodiment of the evaporator-condenser apparatus of the present invention, illustrating the configuration where the volatile liquid, which may include the hydrocarbon refrigerants: butane, propane, isobutane and mixtures thereof, is used as both the refrigerant and heat source is introduced into the core of a jacketed container, such that boiling occurs as a result of the vapor from the liquid being sucked into in inlet of a compressor where it is pressurized to a compressed, heated vapor, and directed into the jacket surrounding the core of the container where heat is removed by the boiling refrigerant therein, thereby forming cool refrigerant liquid, a back pressure valve being utilized to increase the pressure of the compressed, heated refrigerant vapor in the jacket.

DETAILED DESCRIPTION

Briefly, embodiments of the present invention include an apparatus and method for evaporating and condensing liquids in the absence of external heating and cooling, respectively. A volatile liquid, such as a hydrocarbon solvent, contained in either the core or outer chambers of a jacketed container, is cooled by depressurization and boiling utilizing the inlet suction from a compressor, which results in auto-refrigeration of the liquid as it evaporates. The vapor is then pressurized by the compressor and heated as a result of the pressurization process, forming a compressed, heated vapor, and then directed into the other chamber of the jacketed container from where it was vaporized. Heat is removed from the compressed, heated vapor by the auto-cooled (auto-refrigerated) liquid in the other chamber causing the hot, pressurized vapor to transition in turn to a cooler vapor, a warm liquid, and finally a cold liquid without using pumps, chillers, refrigerators, or other apparatus suitable for this purpose. For improved heat transfer, the jacket may include tubing surrounding the core containing the refrigerant. The resulting condensed and chilled solvent liquid can then be removed from the jacketed container through a back pressure valve.

The refrigerant used for heating and cooling in accordance with the teachings of embodiments of the present invention may be used as a solvent for chemical extractions or other chemical processing, and is recirculated. As examples, a recovery basin, a wiped film evaporator and/or a rising/falling film evaporator may be heated to remove liquid solvent from crude extract material for solvent recovery by vaporization, after which vapor may be pressurized in a compressor and the resulting compressed, heated vapor liquefied by use of a back pressure valve at the exit of the condenser portion of the evaporator-condenser, as will be described in greater detail below. Examples of suitable hydrocarbon solvents include propane, butane, and isobutane, and mixtures thereof, and chemical extractions may include extraction of cannabinoids and other essential plant oils. Other refrigerants, such as ammonia and Freon, can be utilized for this process, but are not as useful as hydrocarbon solvents for chemical extractions.

As stated, traditional evaporators are heated by an external ancillary heating system, typically a hot water heater, and traditional condensers are cooled by an external ancillary chilling system, typically a glycol water chiller, $CO_2$, or other refrigerant. Embodiments of the present apparatus and method utilize the same hydrocarbon refrigerant/solvent for all operations, including a refrigerant/solvent having the same identity as that employed for chemical extraction processes. A second refrigeration system, such as a glycol or ethanol chiller, is therefore not required to cool the solvent by heat exchange to induce condensation, nor is a heating system needed to evaporate the liquid which enters the compressor inlet as a vapor; an evaporator-condenser utilizing the chemical extraction solvent as a refrigerant, which is compressed to create compressed, heated vapor has been used to remove the heat from the vapor directly exiting a compressor for condensing the solvent vapor prior to storage or re-use upon discharge from the back-pressure valve.

After exiting the condenser portion of the evaporator-condenser, the liquefied solvent should not contain significant latent heat, and should be a completely condensed and partially cooled liquid. Therefore, the discharged liquid solvent is cooled beyond the condensation temperature.

Thermal mass is related to the quantity of liquid refrigerant at a given pressure, as opposed to the number of kilowatts of ancillary heat and kilowatts of ancillary cooling sources. As the liquid is decompressed in the core, auto-refrigeration of the refrigerant takes place and as compressed, heated vapor is compressed in the jacket, heat is absorbed by the boiling liquid in the core from the superheated vapor in the jacket and condensation of the compressed, heated vapor takes place. There typically is more liquid that is in a state of auto-refrigeration and having a larger density due to a liquid state when compared to the density of the volume of compressed, heated vapor. This then provides the thermal mass required to fully condense the compressed, heated vapor, where, as stated, typically, additional heat is removed by the liquid from the condensed compressed, heated vapor prior to discharge from the back pressure device, thereby releasing a slightly sub-cooled liquid.

As stated, since the solvents used for cannabinoid and other plant extractions, typically n-butane, iso-butane, or propane, are also refrigerants (R290, R600, R600a), both functions are available, and the refrigerant may also be used as the solvent for the extraction process. Propane, when used at saturation (liquid and vapor in dynamic equilibrium), can attain temperatures as low as a few degrees above its freezing point at −188° C. (−138° C. for butane). As a result, propane at saturation can be used to cool a warmer refrigerant to a point where it is completely condensed and partially sub-cooled. The volume of refrigerant that needs to be at a specified pressure to maintain the desired temperature must be determined, along with the ability of the system to compress the vapor into a high-pressure, heated state, which can then lose heat and ultimately condense into a liquid once past the saturated vapor point, thereby providing on-demand heat as needed.

Embodiments of the present evaporator-condenser system is typically operated using a single compressor, which also operates the extraction system. Other embodiments can have a dedicated compressor for achieving lower operating temperatures and maximize solvent transfer with the primary transfer compressor. When utilizing a single compressor, the container core is chilled by the compressor by first filling the column, and subsequently using the compressor to decrease the pressure so that the temperature of the solvent/refrigerant in the core auto-refrigerates until the desired temperature is reached. The thermal capacity is provided by the cooled solvent/refrigerant and the cooled container holding the solvent, typically stainless steel, or other metal, or glass. This thermal energy absorbs heat from the system during the evaporation process. As the thermal energy is absorbed from the incoming superheated solvent vapor, the jacket temperature is controlled by an increase in pressure, which increases in the jacket by use of a back pressure valve at the bottom of the jacket where, once condensed, the cooled liquid is discharged. This back pressure valve provides the heat required to maintain a boiling action within the core of the vessel, while compressor suction is reducing the pressure over the boiling liquid, and compresses the vapor into the jacket of the evaporator-condenser so that the compressed, heated vapor can then lose its heat to the auto-refrigerated refrigerant, and condense and cool prior to discharge.

In other embodiments, the system may be operated using a cold fluid from a process system to condense the gas; that is, the system dedicated to the extraction process, whereby solvent is chilled by the extraction during the extraction phase, thereby supplying a cold fluid to the evaporator section of the evaporator-condenser, while the vapor from this section is compressed into the condenser section of the evaporator-condenser and heat is then absorbed by the fluid in order to condense the compressed vapor. Typically, an extraction process is operated below 0° C., preferably closer to −40° C., as the condensed solvent vapor condensed by the solvent liquid to be evaporated will be maximized, for product and solvent recovery.

The liquid portion in the evaporator-condenser typically has greater than 3× larger volume than the vapor portion, which provides sufficient thermal capacity to condense the vapor since the liquid is much denser than the vapor. Once the liquid is at an operating pressure, its temperature will allow condensation of the compressed, heated vapor exiting the compressor and remaining heat may be removed from the liquid before exiting the back pressure valve.

In accordance with the teachings of embodiments of the present invention, evaporator-condensers may be used in product/solvent recovery systems including a jacketed basin, a wiped film evaporator, a falling film evaporator, or any evaporator system generating a vapor from a liquid source thereof.

Reference will now be made in detail to the present embodiments of the invention, examples of which are illustrated in the accompanying FIGURE. It will be understood that the FIG. 1*s* presented for the purpose of describing a particular embodiment of the invention and is not intended to limit the invention thereto. Turning now to the FIGURE, shown is a schematic representation of a side view of an embodiment of the evaporator-condenser apparatus, 10, of the present invention. Compressor, 12, having a low-pressure inlet and high-pressure outlet, accepts refrigerant or solvent refrigerant vapor, 14, for example R290 (propane), from valve, 16, affixed at the top, 18, of the evaporator portion (refrigerant vapor outlet valve 16 is not required, but is an element of the present system), illustrated in the FIGURE as core, 20, of jacketed evaporator-condenser or jacketed container, 22, by reducing the pressure over the liquid refrigerant, 24, sufficiently to cause refrigerant 24 to boil. At the beginning of the process, core 20 is typically filled to about 80% capacity with liquid refrigerant, 24. The temperature of liquid refrigerant 24 is reduced during the boiling process forming cool propane liquid effective for removing heat introduced through the outer surface of core 20. Core 20 may be refilled with refrigerant 24 once the level drops significantly, or continuously replenished through liquid refrigerant inlet valve, 26, as needed. For extraction systems, liquid inlet valve 26 may be a 3-way valve which can bypass evaporator-condenser 22.

After passing through inlet, 28, of compressor 12, generally after having passed through liquid-vapor separator, 30, which prevents liquids (refrigerants and solvents) from entering compressor 12, vapor 14 is pressurized to a compressed, heated vapor, 32, the heating being due to the compression process. Compressed, heated vapor 32 exits compressor 12 through outlet, 34, and is directed into condenser portion, 36, of evaporator-condenser 22, shown as jacket 36 in the FIGURE, through inlet valve, 38. Heat is removed from the compressed, heated refrigerant vapor 32, by auto-refrigeration of the cool propane liquid since inner surface, 40, of jacket 36 is also the outer surface of core 20, permitting direct heat exchange.

In its simplest form, embodiments of the present invention utilize evaporator-condenser 22 as a single unit, whereby heat from condenser (jacket 36 in the FIGURE) is absorbed by the cold evaporator (core 20 in the FIGURE), resulting in vapor 32 being liquefied in jacket 36. Back pressure valve, 42, is utilized to maintain the heat of the compressed, heated refrigerant 32 within condenser portion 36 of evaporator-condenser 22 so that it may generate additional heat to drive the evaporation process. If back-pressure valve 42 is completely closed, then no heat will transfer into jacket 36. therefore, inlet valve 38 is used to set back-pressure valve 42, and not adjusted afterwards. Once the condensed liquid has collected in condenser 36, additional heat may be removed from the liquid by evaporator 20 of evaporator-condenser 22. The liquefied refrigerant ultimately formed in jacket 36 is caused to exit, 44, back-pressure valve 42, as needed.

If refrigerant 24 has been used as a solvent before being introduced into core 20, it may be drained, 46, through valve, 48, disposed on the bottom, 50, of the evaporator portion, illustrated in the FIGURE as core, 20, of jacketed evaporator-condenser or jacketed container 22, and the extractants removed by known processes, such as by boiling off the solvent, whereby the solvent can be reused for extraction purposes, again becoming all or part of solvent input, 52. Valve 48 becomes unnecessary if the bottom of core chamber 20 is readily removable to collect plant matter.

It should be noted that with redeployment of the valves, and vapor and refrigerant delivery lines, evaporator-condenser apparatus, 10, of the present invention can be operated with jacket 36 as the evaporator portion, whereby sufficiently reducing the pressure over the liquid refrigerant, 24, introduced thereto would cause refrigerant 24 to boil, thereby cooling now condenser portion 36 as core 20, into which compressed, heated vapor 32, is directed after exiting compressor 12 through outlet 34.

In operation, the temperature of the boiling refrigerant in core 20 was measured by measuring the pressure using pressure gauge, 54, while the temperature of the compressed, heated refrigerant vapor directed into condenser portion, 36, of the evaporator-condenser 22 is determined using pressure gauge, 56. When a refrigerant is boiling, it is in the saturated liquid-vapor state (boiling or condensing) where the temperature is defined by the pressure. That is, it resides within the saturated liquid-vapor zone between a saturated liquid and a saturated vapor, where the temperature line remains flat and is 100% determined by pressure. In the saturated liquid-vapor zone there is a mixture of vapor and liquid as it either boils or condenses (ratio from 100:0 to 0:100 percent liquid:vapor)). The fully condensed liquid may be very cold and very high pressure, while the fully evaporated vapor (superheated state) may be very cold and too hot to condense under its conditions.

Having generally described embodiments of the present invention, the following EXAMPLE provides additional details.

EXAMPLE

Enthalpy is pressure based, and since the fluids are either boiling or condensing (temperature of vapor entering the top of the evaporator condenser is usually 10° C.-20° C. hotter than that in the midzone of the evaporator-condenser after substantial heat is removed), in the saturated liquid-vapor mixture zone of the pressure versus enthalpy chart where the temperature is equal to the pressure (See, e.g. the Pressure-Enthalpy Diagram for Refrigerant 290 (Propane) in the 2009 ASHRAE (American Society for Heating, Refrigeration and Air Conditioning Engineers) Handbook-Fundamentals (SI)). The enthalpy value in KJ/kg is multiplied by the mass of propane in kilograms to obtain the total enthalpy thereof.

The following provides data for 100% propane to illustrate that all the hot vapor entering the jacket is condensed by the cold liquid in the core, and the function of the back-pressure valve in maintaining jacket pressure is demonstrated.

(a) Heat Exchange in a Jacketed Vessel:

In a jacketed vessel system, the core is surrounded by a jacket that can either heat or cool the contents of the core. The heating or cooling agent (in this case, vapor) circulates in the jacket, and heat is transferred from the hot vapor in the jacket to the cold liquid in the core, causing the vapor to condense while the liquid absorbs heat, potentially causing it to boil or increase in temperature.

(b) Analyzing the Data:

(i) Basic Thermodynamic Principles:

Enthalpy (H) is a measure of the total heat content of a system, and is used to calculate the energy change in a system when it undergoes a process such as heating, cooling, or phase change (from liquid to vapor or vice versa).

Condensation: is the process where vapor loses heat and turns into liquid.

Boiling: The process where liquid turns into vapor subsequent to absorbing heat.

(ii) System:

Core: 995 $in^3$ volume, or 8.16 kg of propane at 80% operational capacity or 1244 $in^3$ and 10.25 kg of propane at 100% capacity.

Jacket: 967 $in^3$ or 7.98 kg of propane at 100% capacity.

(iii) Using Enthalpy to Illustrate Heat Transfer:

For 100% Propane:

Core (L) pressure: 50 psi (0.446 MPa);

Core (L) temperature: −2° C.;

Core (L) enthalpy: 195 KJ/kg liquid, where L indicates liquid;

Jacket (V) pressure: (0.963 MPa);

Jacket (V) temperature: +44° C.;

Jacket (V) enthalpy: 617 KJ/kg vapor, where V indicates liquid;

Liquid exit temperature: +18° C.;

Liquid exit enthalpy: 246 KJ/kg; and

Total enthalpy removed: 371 KJ/kg.

The significant difference in enthalpy indicates substantial heat has been transferred from the vapor in the jacket to the liquid in the core, causing the vapor to condense and the liquid to gain heat (increasing the temperature of the liquid to counteract the temperature decrease caused by boiling, and potentially boiling the liquid along with the reduction of pressure from the compressor input).

(c) Proving Complete Condensation and Heat Removal:

To prove complete condensation and heat removal, the quantity of vapor entering the jacket equals the amount of condensed liquid (mass balance), and the total enthalpy of the incoming vapor equals the sum of the enthalpy increase in the liquid plus the enthalpy of the incoming vapor (energy balance) are considered.

Given the operational capacities and the enthalpy values before and after the process, the total heat transferred to the liquid and the change in the system's enthalpy can be calculated to demonstrate that the process is efficient in condensing the vapor while transferring heat to the liquid. The reduction in vapor enthalpy in the jacket, matched by the increase in liquid enthalpy in the core and the maintenance of pressure by the back-pressure valve, supports the conclusion that the vapor is being condensed by the cold liquid, facilitating the desired heat transfer.

Through the observed enthalpy changes, the system allows efficient heat transfer from the vapor in the jacket to the liquid in the core, leading to the condensation of the vapor and the heating (and potential boiling) of the liquid. The use of a back-pressure valve to maintain jacket pressure ensures that this process is controlled and efficient, facilitating the desired condensation and heat transfer mechanisms.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A refrigerant evaporator-condenser system without heating and cooling external thereto, comprising:

a source of liquid refrigerant;

an evaporator-condenser, comprising:

a core chamber having an outer wall, a top and a bottom, forming a fluid-tight core chamber for receiving liquid refrigerant from said source of liquid refrigerant and for holding liquid and vapor refrigerant;

an outer chamber surrounding the core chamber, comprising an outer wall a top and a bottom, and having an inner wall comprising the outer wall of the core chamber, forming a fluid-tight outer chamber for receiving compressed and heated refrigerant vapor; and a back-pressure control valve in fluid communication with the outer chamber near proximate the bottom thereof for controlling refrigerant vapor pressure therein and for removing liquid refrigerant; and a gas compressor having an inlet for receiving refrigerant vapor from the core chamber, thereby creating reduced pressure on the liquid and vapor refrigerant in the core chamber, and for generating pressurized, heated refrigerant vapor therefrom, and having an outlet for directing the pressurized, heated refrigerant vapor into the outer chamber.

2. The refrigerant evaporator-condenser system of claim 1, wherein the reduced pressure created by said gas compressor on the liquid and refrigerant vapor causes the liquid refrigerant to boil and cool.

3. The refrigerant evaporator-condenser system of claim 2, wherein the cooled, boiling liquid refrigerant cools the pressurized, heated refrigerant entering the outer chamber.

4. The refrigerant evaporator-condenser system of claim 3, wherein the cooled, pressurized, heated refrigerant entering the outer chamber is liquefied.

5. The refrigerant evaporator-condenser system of claim 1, further comprising a first pressure measuring device in fluid communication with the core chamber and disposed on the top of the core chamber, and a second pressure measuring device in fluid communication with the outer chamber and disposed proximate the top of the outer chamber.

6. The evaporator-condenser system of claim 1, wherein said refrigerant comprises a hydrocarbon refrigerant.

7. The evaporator-condenser system of claim 6, wherein said hydrocarbon refrigerant is chosen from propane, butane, isobutane, and mixtures thereof.

8. The evaporator-condenser system of claim 1, further comprising a liquid-vapor separator between the core chamber and the gas compressor.

9. The evaporator-condenser system of claim 1, wherein said refrigerant is a solvent for plant material.

10. The evaporator-condenser system of claim 1, further comprising: a refrigerant vapor outlet valve in fluid communication with the core chamber through the top of the core chamber for removing refrigerant vapor from the core chamber.

11. The evaporator-condenser system of claim 10, wherein the core chamber has a chamber volume, and the liquid refrigerant is 80% of the core chamber volume.

12. The evaporator-condenser system of claim 1, further comprising: a liquid refrigerant inlet valve in fluid communication with the core chamber through the top of the core chamber for filling the core chamber with a chosen quantity of liquid refrigerant.

13. The evaporator-condenser system of claim 1, further comprising a liquid drain valve in fluid communication with the core chamber through the bottom of the core chamber for draining liquids from the core chamber.

14. The evaporator-condenser system of claim 1, further comprising a compressed, heated refrigerant vapor inlet valve in fluid communication with the outer chamber proximate the top thereof for inputting refrigerant vapor to the outer chamber.

15. A method for condensing pressurized, heated, refrigerant vapor without using external heating and cooling, comprising:

providing liquid refrigerant to a first chamber having an outer wall;

reducing pressure surrounding the liquid refrigerant until it boils and cools, thereby generating refrigerant vapor;

directing the generated refrigerant vapor to an inlet of a gas compressor;

pressurizing the refrigerant vapor, whereby the pressurized refrigerant vapor is heated and compressed, and exits the compressor through an outlet thereof;

introducing the compressed, heated refrigerant vapor into a second chamber surrounding the outer wall of the first chamber, such that the compressed, heated refrigerant vapor is in thermal contact with the outer wall, where it is cooled by heat transfer with the boiling liquid refrigerant;

maintaining pressure of the compressed, heated refrigerant vapor in the second chamber using a back-pressure control valve, such that sufficient heat is transferred to the boiling liquid to maintain boiling;

permitting the compressed, heated refrigerant vapor to cool sufficiently that the compressed, heated refrigerant vapor is liquefied, forming liquefied refrigerant; and removing the liquefied refrigerant through the back-pressure control valve.

16. The method for condensing pressurized, heated, refrigerant vapor of claim 15, wherein said refrigerant comprises a hydrocarbon refrigerant.

17. The method for condensing pressurized, heated, refrigerant vapor of claim 16, wherein said hydrocarbon refrigerant is chosen from propane, butane, and isobutane, and mixtures thereof.

18. The method for condensing pressurized, heated, refrigerant vapor of claim 15, further comprising the step of separating liquid from vapor in a separator before said step of directing the generated refrigerant vapor to the inlet of a gas compressor.

19. The method for condensing pressurized, heated, refrigerant vapor of claim 15, wherein said refrigerant is a solvent for plant material, and said method further comprises the step of draining said refrigerant liquid containing plant material dissolved in said liquid refrigerant provided to the first chamber.

* * * * *